US006650219B1

(12) United States Patent
Widiger et al.

(10) Patent No.: US 6,650,219 B1
(45) Date of Patent: Nov. 18, 2003

(54) IGNITION COIL CORE ISOLATION

(75) Inventors: Alex William Widiger, Canton, MI (US); David Charles Stine, Canton, MI (US); Todd Christopher Sexton, Ypsilanti, MI (US); William Douglas Walker, Saline, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 125 days.

(21) Appl. No.: 09/718,035

(22) Filed: Nov. 21, 2000

(51) Int. Cl.[7] ..... H01F 27/30
(52) U.S. Cl. ..... 336/198; 336/210; 336/234
(58) Field of Search ..... 336/90, 92, 96, 336/98, 107, 192, 198, 212, 234, 210, 211; 123/634, 635

(56) References Cited

U.S. PATENT DOCUMENTS

| | | | | |
|---|---|---|---|---|
| 5,986,532 A | * | 11/1999 | Kikuta et al. | 336/96 |
| 6,094,122 A | | 7/2000 | Sexton | 336/96 |
| 6,114,933 A | | 9/2000 | Widiger et al. | 336/96 |
| 6,308,696 B1 | * | 10/2001 | Kondo et al. | 336/98 |
| 6,332,458 B1 | * | 12/2001 | Shimada et al. | 336/198 |
| 6,337,616 B1 | * | 1/2002 | Sato et al. | 336/90 |
| 6,448,878 B1 | * | 9/2002 | Mullins et al. | 336/90 |

* cited by examiner

*Primary Examiner*—Tuyen T. Nguyen
(74) *Attorney, Agent, or Firm*—Brinks Hofer Gilson & Lione

(57) ABSTRACT

A pencil ignition coil assembly module (40) that has a frusto-conically tapered core (46) and encapsulation (280) surrounding the side of the core. Features (216, 230, 234) center the core to a bobbin 48. A retainer (240, 240A) captures the core within the bobbin.

13 Claims, 6 Drawing Sheets

IGNITION COIL CORE ISOLATION

BACKGROUND OF THE INVENTION

1. Field of the Invention

This invention relates generally to internal combustion engine spark ignition systems, and in particular to an ignition coil module that contains a ferromagnetic core about which primary and secondary coils are coaxially disposed. The ignition coil module may be a type that mounts on an engine over, and in direct electric connection with, an engine-mounted spark plug, in the manner of modules referred to by various names such as pencil-coil modules or coil-on-plug modules.

2. Background Information

Known internal combustion engines comprise cylinder blocks containing individual cylinders that are closed at one end by an engine cylinder head that is attached to the engine block. In a spark-ignition engine, the cylinder head contains threaded spark plugs holes, each of which is open to a respective cylinder. A respective spark plug is threaded into the respective hole to close the respective hole. External to the respective cylinder, each spark plug comprises a central electric terminal that is available for electric connection with a mating terminal of a secondary of the spark-ignition system.

Known spark ignition systems comprise what are sometimes called coil-on-plug type ignition coil modules or pencil-coil modules. Any such module comprises both a wound primary coil and a wound secondary coil. At the proper time in the engine operating cycle for firing a particular spark plug, electric current flowing through the primary of the respective module is abruptly interrupted to induce a voltage in the secondary coil sufficiently high to create a spark across gapped electrodes of the spark plug that are disposed within combustion chamber space of the respective engine cylinder, igniting a combustible fuel-air mixture to power the engine.

Examples of coil-on-plug modules are found in various patents including U.S. Pat. Nos. 4,514,712; 5,128,646; 5,590,637; and 5,870,012; as well as in U.K. Patent Application GB 2,199,193A. A common characteristic of such modules is that the primary and secondary coils are disposed one within the other, concentric with a common axis that is coincident with the spark plug central terminal. The coils may be bobbin-mounted and encapsulated. Various arrangements for providing electric circuit continuity of the secondary coil to the spark plug terminal are shown.

In certain engines, the threaded spark plug mounting hole may be at the bottom of a bore, or well, that extends inward from an outer surface of a cylinder head. For any of various reasons, such bores may be relatively long and narrow, and it is for such bores that pencil-coil ignition modules are especially suited. U.S. Pat. No. 6,094,122 "MECHANICAL LOCKING CONNECTION FOR ELECTRIC TERMINALS", pending U.S. patent application Ser. No. 09/391,571 "PENCIL IGNITION COIL ASSEMBLY MODULE ENVIRONMENTAL SHIELD", and pending U.S. patent application Ser. No. 09/392,047 "PENCIL IGNITION COIL ASSEMBLY MODULE" disclose an example of such a module.

An advantage of a pencil-coil module is that when it is installed on an engine, the wiring that runs to it from a signal source need carry only primary coil current, because the entire secondary coil is contained within the module and is for the most part sheltered within the bore. However, for proper ignition system performance, primary and secondary coils must be sized to reliably deliver a secondary voltage sufficiently large to spark the plug. The primary and secondary coils are typically encased in respective encapsulations which must possess physical characteristics suitable for providing protection both for the harsh underhood environment where an ignition coil module is located and for the voltages that must necessarily be generated. Because of dimensional constraints imposed by the design of an engine on a pencil-coil module, it is believed that a module possessing an ability to achieve specified performance criteria within confined space would be valuable to an engine manufacturer. It is further believed that the pencil-coil module shown in U.S. Pat. No. 6,094,122 and the two referenced pending patent applications possesses such value, and that further improvements can increase the value of such a product.

SUMMARY OF THE INVENTION

The present invention relates to improvements in an ignition coil module, especially improvements in the ferromagnetic core of the module and the manner in which the core is associated with a bobbin within which the core is coaxially disposed. It is believed that improved efficiencies in the fabrication and performance of ignition coil modules will result from use of the inventive principles disclosed hereinafter. While the inventive improvements can provide particular benefit in a module like the pencil-coil module of U.S. Pat. No. 6,094,122, they may also enjoy application to other ignition coil modules.

The improvements can enable a core to be efficiently assembled into a bobbin and to attain precise coincidence of the core centerline to the bobbin centerline. Effectively encapsulating the core within the bobbin is also an aspect of the invention. The core and bobbin employ features relating one to the other in an assured dimensional relationship that allows encapsulant that is introduced into the open upper end of the bobbin to flow efficiently into the bobbin interior and fill clearance space that is intentionally provided between the outer surface of the core and the inner surface of the bobbin. This results in a construction that is believed more robust because of the improved thermal/mechanical isolation provided between dissimilar materials in the bobbin and the core. A substantial surface area of the core is spaced from the wall of the bobbin, and the intervening space filled by encapsulant. Because of that construction, it is believed that thermal and mechanical factors acting on the module while in use may have less of an effect on design intent than they would absent the present invention.

The construction also allows additional magnetic circuit elements, such as magnetic cylinders, to be associated with the core within the bobbin interior. A retainer associates with the open upper end of the bobbin to keep the core, including any additional magnetic circuit elements associated with the core within the bobbin, in place before encapsulant is introduced, yet the retainer possesses features that allow encapsulant to flow efficiently past it as the encapsulant is introduced into the bobbin. When an additional magnetic circuit element is placed over a core that has been inserted into the interior of a bobbin, the retainer may also serve to dimensionally center that additional magnetic circuit element to the centerline of the core.

The present invention relates to a pencil ignition coil assembly module that possesses an organization and arrangement of elements believed to render it well suited for meeting specified performance criteria within the confines of limited space. Moreover, it is believed that the inventive module is well suited for reliable and cost-effective mass production, thereby making it especially attractive for use in automotive vehicle internal combustion engines.

One general aspect of the invention relates to an ignition coil module having an imaginary longitudinal centerline and comprising a primary coil for conducting primary electric current, and a secondary coil that is electromagnetically coupled with the primary coil for delivering a spark plug firing voltage when primary current conducted by the primary coil abruptly changes. A bobbin comprising an imaginary centerline is disposed coincident with the module centerline and comprises a sidewall having an inner surface that laterally bounds a hollow interior space and an outer surface on which one of the coils is disposed. A ferromagnetic core is disposed within the interior space of the bobbin and has a longitudinal centerline coincident with the centerlines of both the module and the bobbin. The core comprises an outer surface having a confronting area which confronts and is spaced from a confronted area of the inner surface of the bobbin sidewall, and the confronting area of the outer surface of the core and the confronted area of the inner surface of the bobbin sidewall are disposed on respective imaginary frustums having their centerlines coincident with the centerlines of the core and the bobbin.

Another general aspect relates to an ignition coil module having an imaginary longitudinal centerline and comprising a primary coil for conducting primary electric current and a secondary coil that is electromagnetically coupled with the primary coil for delivering a spark plug firing voltage when primary. current conducted by the primary coil abruptly changes. A bobbin comprising an imaginary centerline is disposed coincident with the module centerline and comprises a sidewall having an inner surface that laterally bounds a hollow interior space and an outer surface on which the secondary coil is disposed. A ferromagnetic core is disposed within the interior space of the bobbin and has a longitudinal centerline coincident with the centerlines of both the module and the bobbin. The core comprises an outer surface having a confronting area which confronts and is spaced from a confronted area of the inner surface of the bobbin sidewall, and encapsulant fills the interior space of the bobbin between the confronting area of the outer surface of the core and the confronted area of the inner surface of the bobbin sidewall.

Another general aspect relates to a ferromagnetic core having an imaginary longitudinal centerline and comprising a stack of individual flat laminations arranged parallel to the centerline. Two of the laminations bound the stack. Each lamination comprises opposite longitudinal edges that are non-parallel to the centerline to endow zones at opposite sides of the core with a substantially frustoconical profile, and the zones are separated by flat outer faces of the two laminations bounding the stack.

Another general aspect relates to a ferromagnetic core having an imaginary longitudinal centerline running from a proximal end to a distal end and comprising a stack of individual flat laminations arranged parallel to the centerline. Two of the laminations bound the stack. Each lamination comprises opposite longitudinal edges that endow opposite sides of the core with zones that have a defined longitudinal profile and that are separated by flat outer faces of the two laminations bounding the stack. Some of the laminations comprise tabs projecting outward from their longitudinal edges beyond the defined longitudinal profile.

Another general aspect relates to an ignition coil module having an imaginary longitudinal centerline and comprising a primary coil for conducting primary electric current and a secondary coil that is electromagnetically coupled with the primary coil for delivering a spark plug firing voltage when primary current conducted by the primary coil abruptly changes. A bobbin comprising an imaginary centerline is disposed coincident with the module centerline and comprises a sidewall having an inner surface that laterally bounds a hollow interior space and an outer surface on which one of the coils is disposed. A ferromagnetic core is disposed within the interior space of the bobbin and has a longitudinal centerline coincident with the centerlines of both the module and the bobbin. The core comprises an outer surface having a confronting area which confronts and is spaced from a confronted area of the inner surface of the bobbin sidewall. A retainer fits to the proximal end of the bobbin to capture the core within the bobbin. The retainer comprises a ring that is disposed within the interior space and comprises formations that provide clearance to the bobbin sidewall to allow encapsulant that is introduced into the interior space via the proximal end of the bobbin to flow past the retainer and fill the interior space between the confronting and confronted areas.

Another general aspect relates to a method of encapsulating a ferromagnetic core within a bobbin of an ignition coil module. The method comprises providing a bobbin comprising a sidewall having an exterior surface on which one of a primary and a secondary coil is disposed and an interior surface bounding a hollow interior space that is open at a longitudinal end. A ferromagnetic core is disposed within the hollow interior of the bobbin via the open longitudinal end of the bobbin to circumferentially locating the core to the bobbin and to place an imaginary longitudinal centerline of the core coincident with an imaginary longitudinal centerline of the bobbin. The core is captured within the bobbin by disposing on the bobbin at the open longitudinal end, a retainer that has a cooperation with the bobbin allowing encapsulant to flow past the retainer. Encapsulant flows into the interior space of the bobbin to encapsulate the core by introducing the encapsulant through the open longitudinal end of the bobbin and flowing the encapsulant past the retainer.

Further aspects will be seen in the ensuing description, claims, and accompanying drawings.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT(S)

Figure 1:
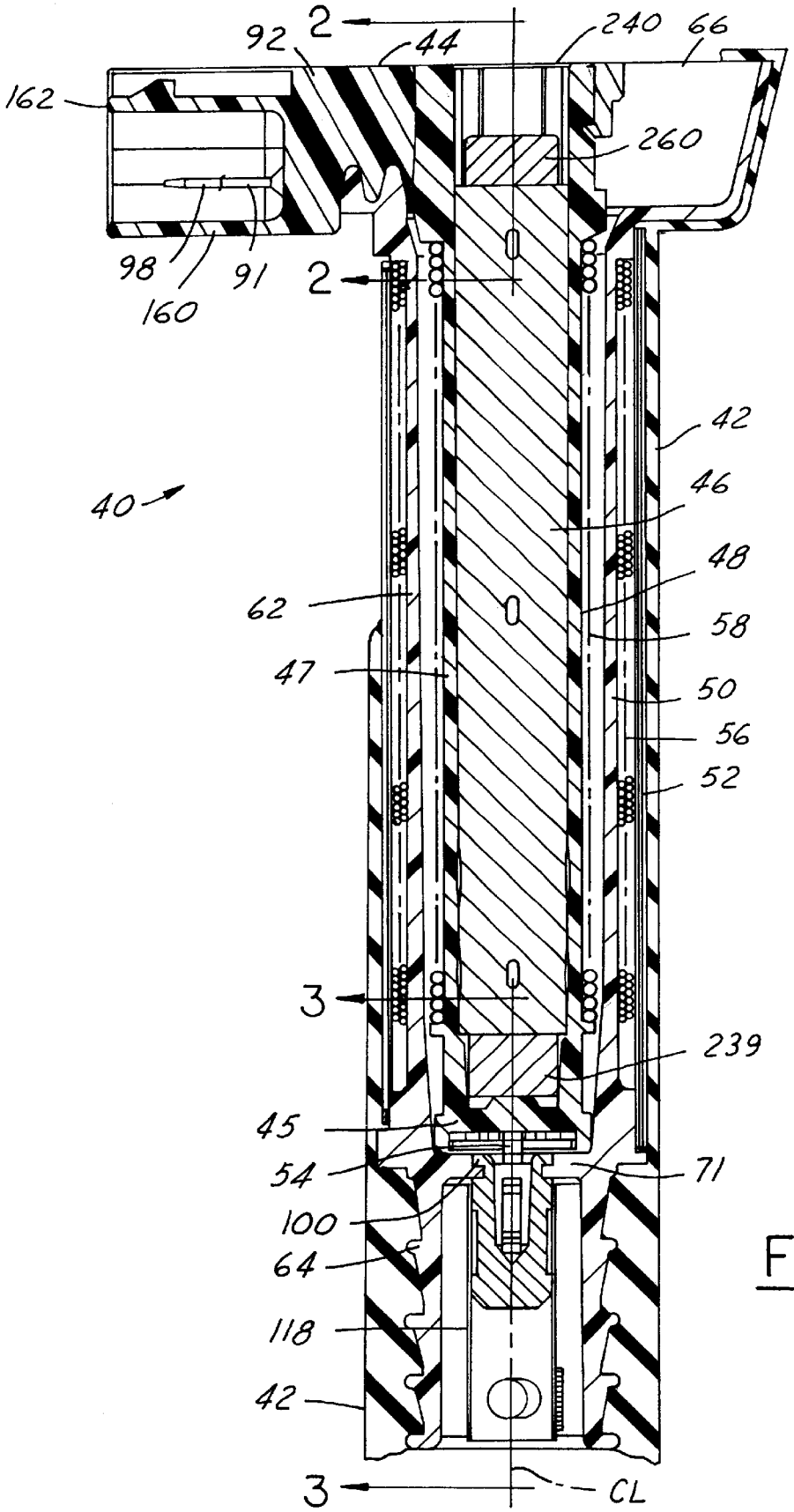
FIG. 1 is a longitudinal cross section view through the centerline of an exemplary ignition coil module embodying principles of the present invention.
Figure 4:
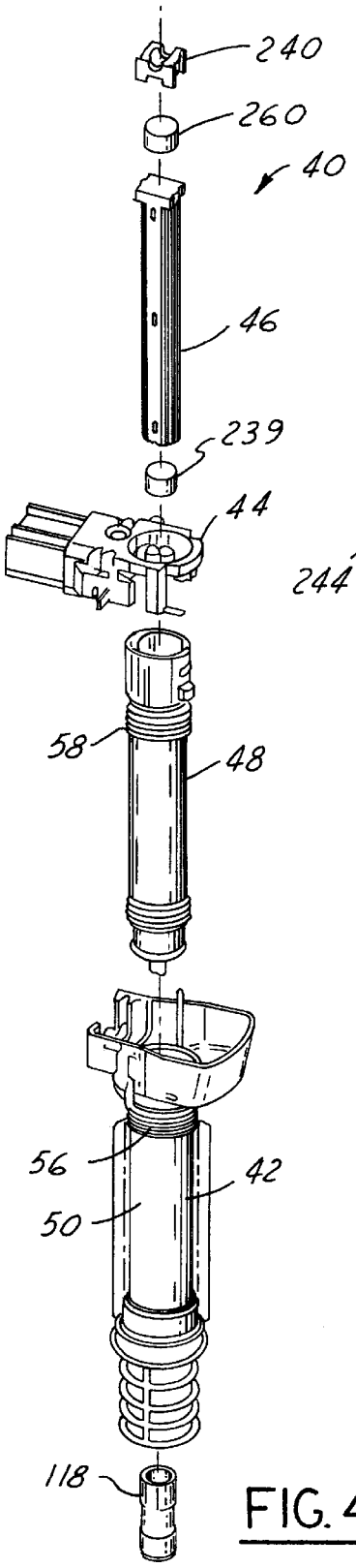
FIG. 4 is an exploded perspective view of the ignition coil module of FIG. 1.

FIGS. 1 through 4 show the general organization and arrangement of an example of a pencil-coil ignition module 40 embodying principles of the present invention. Module 40 has an imaginary longitudinal centerline CL, and for convenience in the following description of the orientation of certain module components along centerline CL, reference will on occasion be made to proximal and distal directions. FIGS. 1 and 4 show several module components, either in whole or in part. They are an environmental shield 42, a connector assembly 44, a ferromagnetic core 46, a secondary bobbin 48, a primary bobbin 50, a primary coil 56, a secondary coil 58, and a ferromagnetic shell 52.

In a number of respects, the construction of module 40 is generally like the one disclosed in U.S. Pat. No. 6,094,122 and pending U.S. patent applications Ser. No. 09/391,571 and Ser. No. 09/392,047. Module 40 may be viewed as comprising a succession of cylindrical layers about central ferromagnetic core 46. The components just mentioned form some of those cylindrical layers and from innermost to outermost they are: secondary bobbin 48; secondary coil 58; primary bobbin 50; primary coil 56; shell 52; and environmental shield 42. Additional layers of insulative encapsulation, that will eventually be described, are also present.

Primary coil 56 is disposed around the outside of primary bobbin 50, and secondary coil 58, around the outside of secondary bobbin 48. Secondary bobbin 48 is disposed within the hollow interior of primary bobbin 50, and core 46 is disposed within the hollow interior of secondary bobbin 48. Core 46 comprises a stack of individual ferromagnetic laminations forming a generally cylindrical shape, but comprising certain novel characteristics and features that will be described in detail later. Shell 52 comprises ferromagnetic laminations disposed face-to-face and rolled in a generally tubular shape to leave a gap that provides circumferential discontinuity between confronting edges.

A longitudinally intermediate portion of secondary bobbin 48 comprises a cylindrical tubular wall 47 on the exterior of which secondary coil 58 is disposed. At its distal end, bobbin 48 is closed by a transverse wall 45, but is open at its proximal end. An electric terminal 54 is disposed centrally in wall 45. One termination of the wire that forms secondary coil 58 has electric continuity with terminal 54. At the proximal end of bobbin 48, an opposite termination of the wire that forms secondary coil 58 has electric continuity with another electric terminal that mates with a terminal of connector assembly 44.

A longitudinally intermediate portion of primary bobbin 50 comprises a circular cylindrical tubular wall 62 on the exterior of which primary coil 56 is disposed. At its distal end, bobbin 50 comprises a tubular walled terminal shield 64, and at its proximal end, a hollow, generally rectangular-walled bowl 66 that is open to the hollow interior of tubular wall 62. Opposite terminations of the wire that forms primary coil 56 have electric continuity to respective electric terminals mounted on bowl 66. A terminal 100 is disposed centrally in a transverse wall 71 of primary bobbin 50. Wall 71 is located in bobbin 50 approximately at the junction of the proximal end of shield 64 and the distal end of wall 62. A proximal portion of terminal 100 mates with terminal 54. A terminal 118 that is assembled to terminal 100 is circumferentially surrounded by shield 64. When ignition coil module 40, including terminal 118, is assembled to the engine, the open distal end of terminal 118 fits onto an exposed central terminal of a spark plug.

Each coil 56, 58 is fabricated from a respective known type of electric wire that comprises an electrically conductive core covered by a thin layer of insulation. Each coil 56, 58 is wound from a respective wire on its respective bobbin 50, 48 by known coil winding equipment and methods. The process for winding primary coil 56 includes associating the two end segments of the primary coil wire with the two electric terminals mounted on bowl 66. The process for winding secondary coil 58 also associates the wire ends with the two electric terminals on the secondary bobbin.

Connector assembly 44 comprises a body 92 of electrically non-conductive material that contains two separate electric conductors. One conductor comprises two electric terminals at one end, and another conductor comprises one electric terminal at that same end. The three terminals are arranged in a geometric pattern matching that of the two terminals for the primary coil and the one terminal for the secondary coil at the proximal ends of the two bobbins.

The opposite termination of each respective conductor of connector assembly 44 comprises a respective terminal 91, 98 pointing in a direction that is transverse to centerline CL. Terminals 91, 98 are bounded by a surround 160 of body 92 thereby forming an electric connector 162 to which a mating connector of a wiring harness (not shown) can be attached to connect module 40 with a signal source for firing a spark plug to which the module is connected.

Connector assembly 44 is assembled to bobbins 48, 50 by properly aligning the connector assembly with proximal ends of the bobbins and advancing it toward the bobbins distally along centerline CL to mate the three terminals confronting the bobbins with the three terminals at the proximal ends of the bobbins.

An example of how the coil wire ends are connected to the respective terminals of the bobbins and various terminals mate with other terminals is described in U.S. Pat. No. 6,094,122 and the two pending U.S. patent applications Ser. No. 09/391,571 and Ser. No. 09/392,047.

Environmental shield 42 forms an enclosure of module 40 while leaving an outer end of electric connector 162 open for attachment of the mating connector and leaving the distal end of shield 64 open so terminal 118 can connect to a spark plug. Shield 42 also extends distally beyond shield 64 to form a boot (not shown) that associates with an engine spark plug bore when module 40 is installed on an engine to fit terminal 118 onto a central terminal of a spark plug disposed in the bore. The boot, which is shown in U.S. Pat. No. 6,094,122 and the two pending U.S. patent applications Ser. No. 09/391,571 and Ser. No. 09/392,047, essentially seals the spark plug bore to the outside ambient environment.

Figure 5:
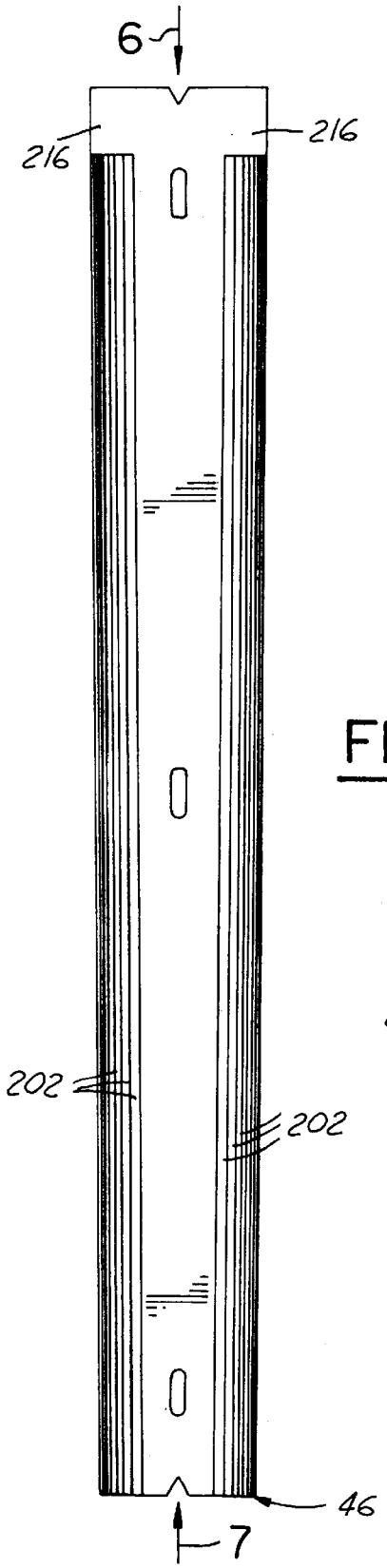
FIG. 5 is a longitudinal view of one element of the module of FIG. 1, namely a ferromagnetic core.
Figure 6:
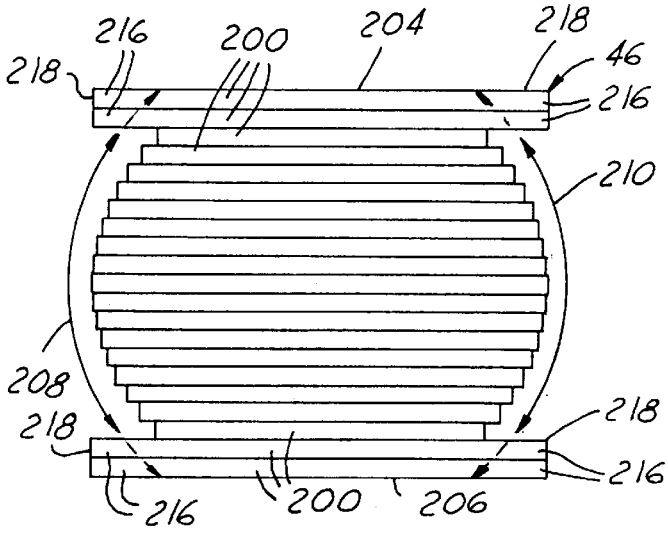
FIG. 6 is a view looking toward the distal end of the core of FIG. 5, on an enlarged scale, in the direction of arrow 6.
Figure 7:
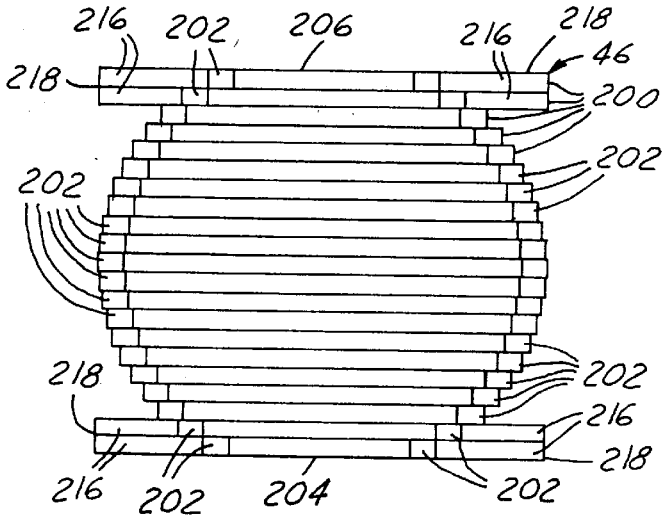
FIG. 7 is a view looking toward the proximal end of the core of FIG. 5, on an enlarged scale, in the direction of arrow 7.

FIGS. 5, 6, and 7 show that core 46 comprises a stack of individual ferromagnetic laminations 200. The proximal end of core 46 is at the top and the distal end at the bottom in FIG. 5. The laminations are flat and disposed in planes that are parallel with the core centerline. They are also individually dimensioned such that when stacked together face-to-face in proper order in the stack, they endow zones in opposite halves of core 46 with a substantially frustoconical profile that tapers radially inward toward the distal end, except where the outmost laminations that bound the stack endow the core with limited zones having a flat profile that is parallel to the core centerline. The frustoconical taper of the two opposite zones that separate the flat zones is achieved by tapering the opposite longitudinal edges 202 of individual laminations 200 radially inward from the proximal end to the distal end. The two laminations that bound the stack present their flat faces 204, 206 at opposite sides of core 46, and it is those faces which form the zones that are substantially parallel to the core centerline. Thus, core 46 presents one pair of opposite zones that are flat and mutually parallel because they are defined by faces 204, 206 and another pair of opposite zones 208, 210 that are substantially frustoconically tapered because of the tapering of the outer longitudinal edges of the laminations.

As will be more fully explained later, the process of fabricating bobbin 48 results in bobbin's cylindrical tubular wall 47 having draft. The cone angle of the frustum that generally describes zones 208, 210 is selected in relation to the draft angle of the inner surface of bobbin's cylindrical tubular wall 47 to provide a well-defined space 211 (seen best in FIG. 2) between the two tapered zones of the core and the two respective areas of the inner bobbin surface confronted by the respective zones 208, 210. A particular cone angle may provide a spacing distance that is generally uniform along the length of the core. The dimension across the core between the flat out face 204 of the outermost lamination at one side of the stack and the outer face 206 of the outermost lamination at the opposite side of the stack is selected to provide clearance to bobbin's cylindrical tubular wall 47 along the full length of core 48, but the clearance may become quite small, even to the point of being almost non-existent, at the distal end.

The last two laminations that bound the stack at each opposite side are constructed with tabs 216 that form locating keys 218 at the proximal end of core 46. The illustrated embodiment comprises four such keys 218, one pair at one side of core 46, and the other pair at the other side. Keys 218 protrude outward beyond the nominal core profile. When the core is assembled into bobbin 48, keys 218 associate with features at the proximal end of the bobbin, to be hereinafter described, for locating the core to the bobbin, including establishing coincidence of the core centerline to the bobbin centerline.

Injection molding of synthetic material, i.e. plastic, is an advantageous process for fabricating each bobbin 48, 50. Because of their long, narrow shapes, the bobbin sidewalls must have sufficient draft to allow parts of the molds that form them to separate after the plastic has been injected into the molding cavities. Hence the inner surface of bobbin sidewall 47 may lie on a frustum of a cone. By making core 46 in the manner described above and by providing spacing distance between mutually confronting areas of the outer surface of the core and inner surface of bobbin sidewall 47, core 46 may subsequently be efficiently and effectively encapsulated within bobbin 48.

Figure 8:
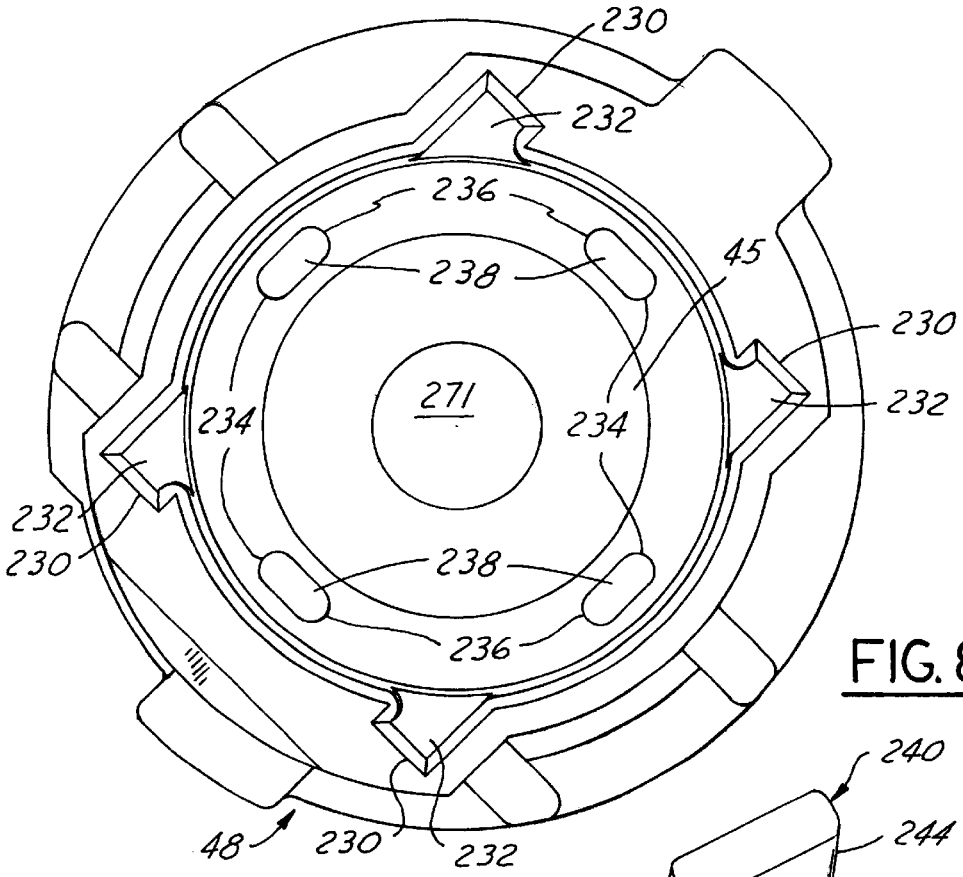
FIG. 8 is a view, on an enlarged scale, looking toward the distal end of another element of the module of FIG. 1, namely a secondary coil bobbin.

FIG. 8 shows the interior of bobbin 48 and features that provide for the centerline of core 46 to attain coincidence with the bobbin centerline when the core is inserted into the bobbin via the open proximal end of the bobbin. The bobbin comprises a first formation 230 of key receptacles 232 at its proximal end, and a second formation 234 of centering pads 236 at the distal end. Receptacles 232 are arranged in a pattern corresponding to that of keys 218 such that when core 46 is properly circumferentially registered with bobbin 48 to align each key 218 with a respective receptacle 232, and core 46 is advanced distally into bobbin 48, keys 218 will lodge in receptacles 232 with a fit that serves to accurately circumferentially locate the core to the bobbin and secure coincidence of the core centerline to the bobbin centerline.

Pad formation 234 comprises a set of four pads 236 arranged generally 90° apart about the bobbin centerline and offset at approximately 45° to the pattern of receptacles 232. Each pad 236 comprises a similarly inclined surface 238 to the centerline of the bobbin, as perhaps best shown by FIG. 3. As the insertion of core 46 into the bobbin is being completed, the distal end of the core will contact one or more surfaces 238. If the centerline of the core is exactly coincident with that of the bobbin at the distal end, the outer edge of the distal end of the core will contact all four surfaces 238 essentially simultaneously. However if there is some disparity between the centerlines, the distal end of the core will initially contact less than all four pad surfaces. The nature of the interaction of a contacted pad with the core, as core insertion is being completed, is such that the distal end of the core will be forced in a sense that tends to bring its centerline into coincidence with that of the bobbin. The core and bobbin may be dimensioned to cause the core to finally come to rest on all four surfaces 238, or alternatively, to come to rest on a cylindrical magnetic circuit element 239, to be more fully described later, that is placed at the bottom of the bobbin interior prior to insertion of the core into the bobbin. In any event, surfaces 238 assure centering of the distal end of the core to the bobbin.

At the same time that the distal end of the core is being centered to the bobbin, keys 218 are lodging in receptacles 232 to center the proximal end of the core to the bobbin. The core and bobbin are dimensioned such that the distal end of the core finally comes to rest on pad surfaces 238, or alternatively on element 239 when such an element is present, with the bottom edges of keys 218 being spaced from surfaces at the bottoms of receptacles 232. Core 46 is substantially centered throughout its length to bobbin 48, and space 211 is well-defined around the outside of the core for subsequent filling with encapsulant.

Figure 9:
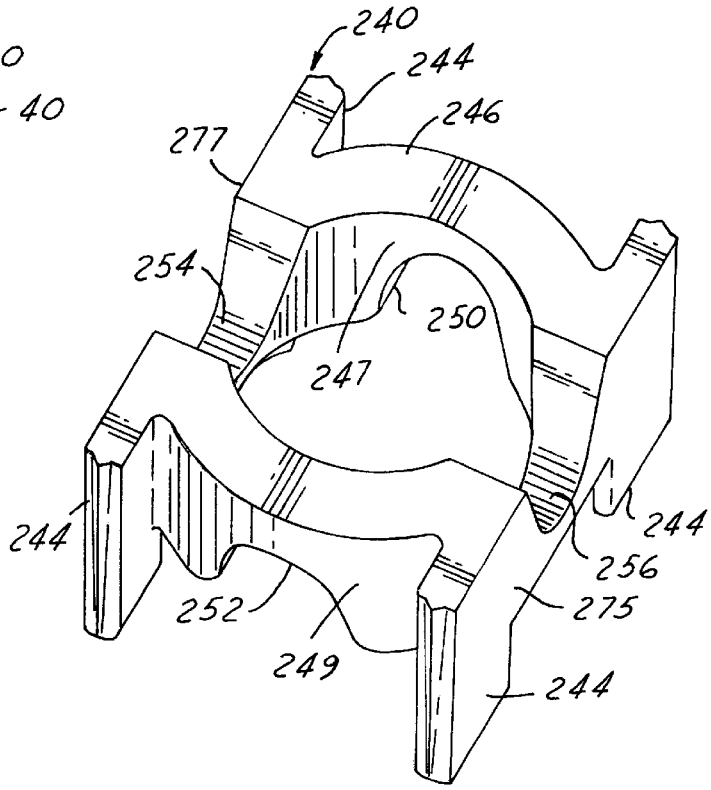
FIG. 9 is a perspective view, on an enlarged scale, of another element of the module of FIG. 1, namely a retainer.
Figure 10:
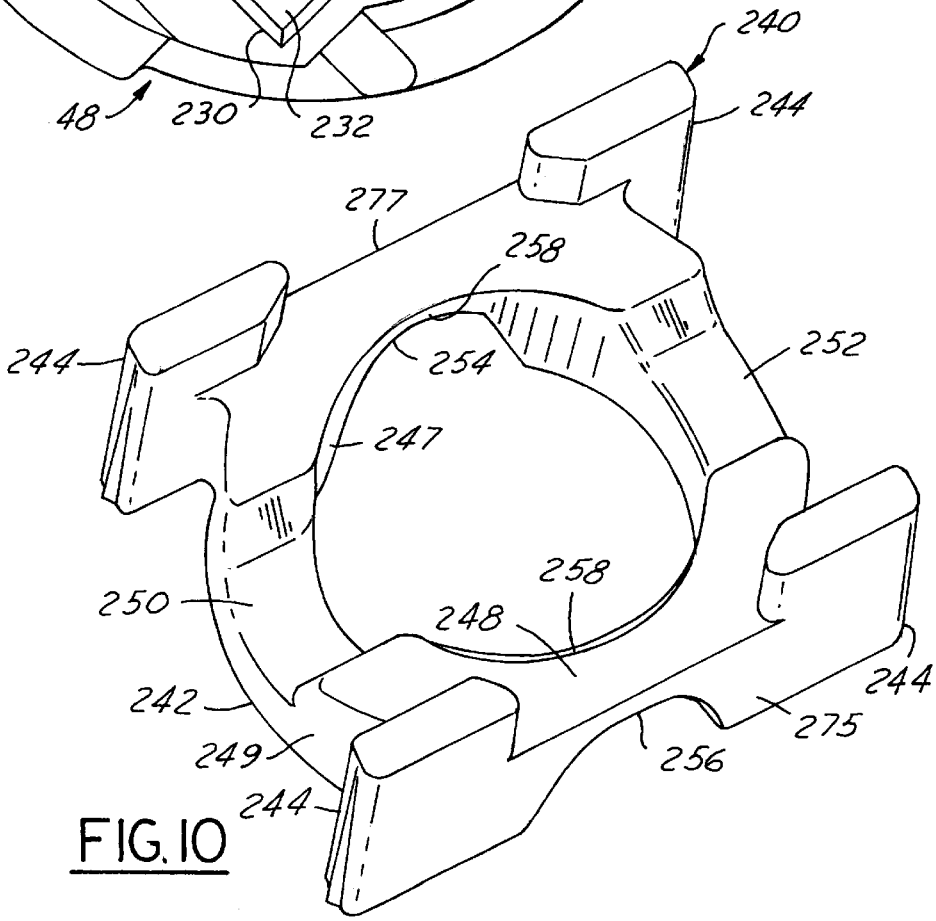
FIG. 10 is a perspective view of the retainer from a different direction.
Figure 12:
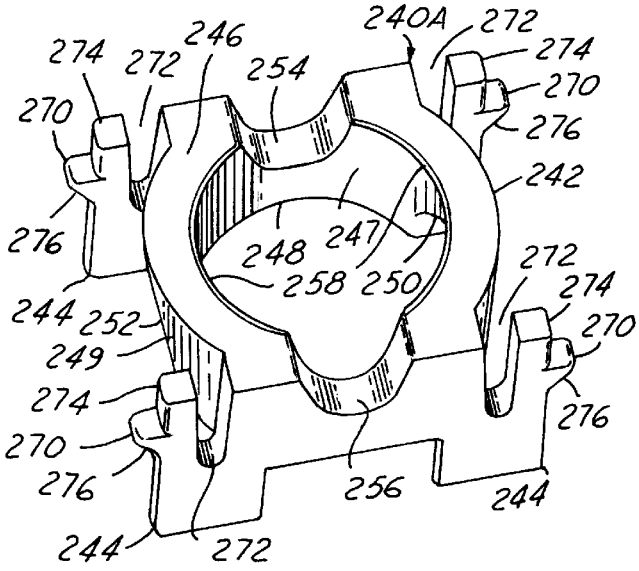
FIG. 12 is a perspective view similar to FIG. 9 showing an alternate embodiment of retainer.
Figure 13:
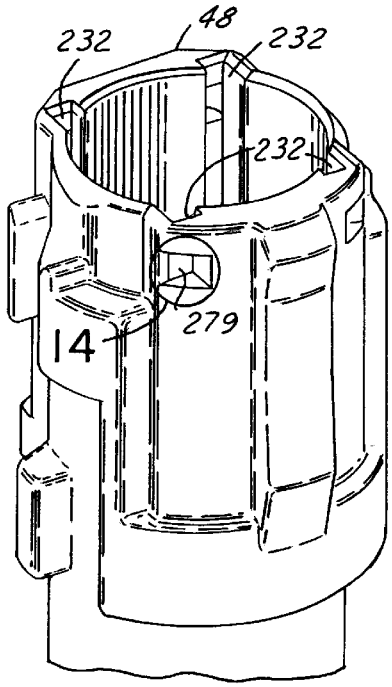
FIG. 13 is a fragmentary view of a bobbin modification for the alternate retainer.
Figure 14:
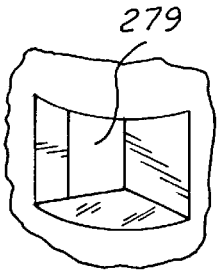
FIG. 14 is an enlarged view in circle 14 in FIG. 13.
Figure 15:
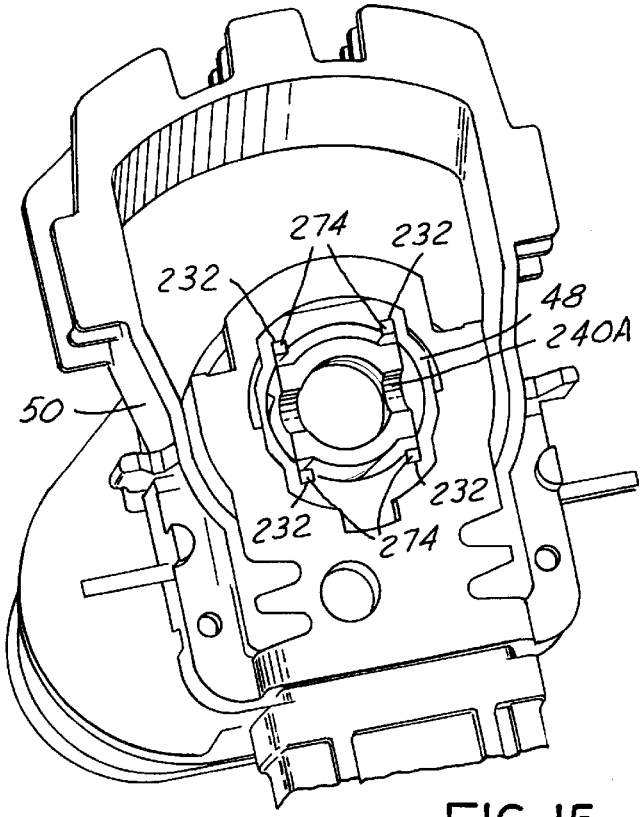
FIG. 15 is a perspective view showing the alternate embodiment in assembly with the bobbin.

It may also be desirable to capture core 46 within bobbin 48 using a retainer 240 that is shown in FIGS. 9 and 10. Retainer 240 comprises a generally circular ring 242 that has posts 244 arranged in the same pattern as the patterns of receptacles 232 and keys 218. Posts 244 project both outwardly and distally from ring 242 as shown by the perspective view of FIG. 9 looking toward the distal end of the retainer. Ring 242 has generally flat, parallel proximal and distal faces 246, 248 respectively, a radially inner face 247, and a radially outer face 249.

After core 46 has been assembled into bobbin 48, retainer 240 is aligned with the proximal end of the bobbin and circumferentially indexed to align each post 244 with a corresponding receptacle 232. The retainer is then advanced to cause the distal end of each post 244 to enter a respective receptacle 232 in which a respective key 218 of core 46 has already been lodged. Because it is placed on the bobbin before the core is encapsulated, retainer 240 possesses features that facilitate the efficient flow of encapsulant past it during core encapsulation. Distal face 248 contains a pair of concave recesses 250, 252 on diametrically opposite sides. Each recess is disposed between a respective pair of posts 244 and extends fully radially through the ring between inner and outer faces 247, 249. At 90° to recesses 250, 252, proximal face 246 contains a pair of concave recesses 254, 256, each of which is between a different pair of posts and also extends fully radially through the ring between inner and outer faces 247, 249.

Figure 2:
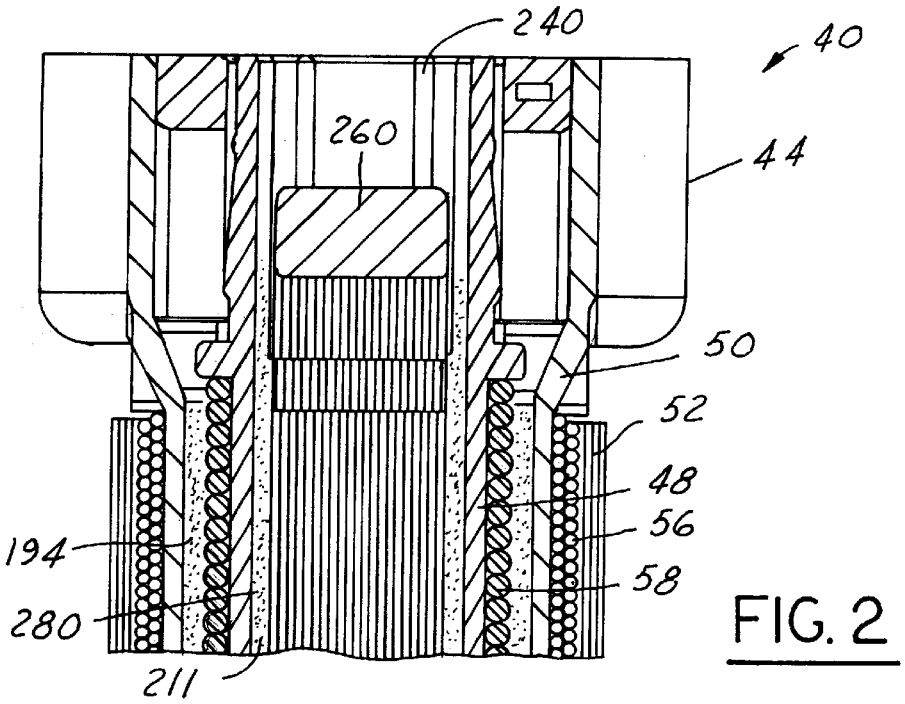
FIG. 2 is an enlarged cross section view taken in the direction of arrows 2—2 in FIG. 1.
Figure 3:
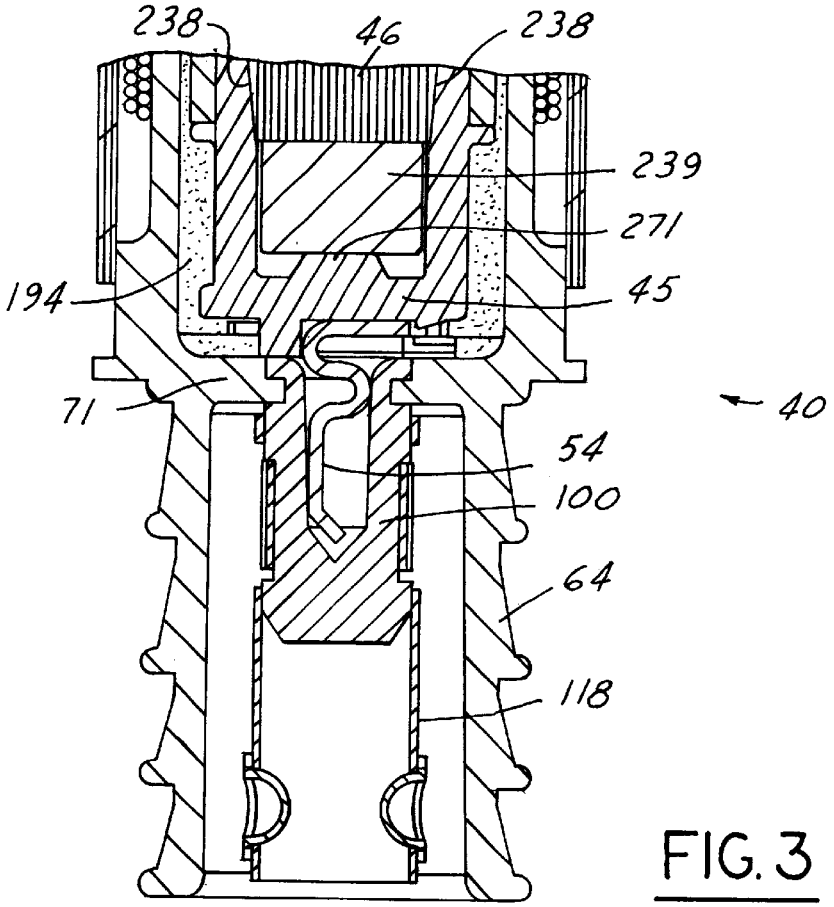
FIG. 3 is an enlarged cross section view taken in the direction of arrows 3—3 in FIG. 1.

The retainer may also possess the capability for centering an additional magnetic circuit element to the core. Such an element 260 is shown in FIGS. 1, 2, and 4 as a cylindrical magnet. At distal face 248, portions of the inner edge of ring 242 which are to either side of recesses 250, 252 contain a chamfer 258 that is concentric with the centerline of the retainer. When element 260 is placed between retainer 240 and the flat proximal end of core 46, chamfer 258 acts on the outer proximal edge of element 260 to cause the element to become centered to the retainer. Because the retainer centers itself to the core via its association with bobbin 48, element 260 is inherently centered to core 46 as retainer posts 244 are lodging in receptacles 232. The encapsulant that is introduced to encapsulate core 46 may also encapsulate element 260 and retainer 240.

Retainer 240 is preferably fabricated from a suitable plastic using an injection molding process. For conveniently securing retainer 240 to bobbin 48 to capture core 46 and any additional magnetic circuit elements in the bobbin interior, posts 244 may be dimensioned for an interference press fit in receptacles 232.

Although the Figures show use of element 260 in module 40, it should be appreciated that in an alternate module embodiment, element 260 may not be used. When element 260 is not used, retainer 240 will be disposed more interiorly of bobbin 48, with recesses 232 having sufficient depth to accommodate such an alternative. Each element 239, 260 may or may not be used in any given embodiment of module, with the presence or absence of each being independent of the presence or absence of the other. When element 239 is present, it is placed at the distal end of core 46 between bobbin wall 45 and the flat distal end of the core. In this region, the bobbin sidewall may be dimensioned to accurately center element 239. Wall 45 may contain a central circular plateau 271 on which the flat distal end of element 239 rests.

FIGS. 12, 13, 14, and 15 show an alternate form of retainer 240A and corresponding modifications to bobbin 48. Retainer 240A still comprises a generally circular ring 242 that has posts 244A arranged in the same pattern as the patterns of receptacles 232 and keys 218. Posts 244A, that differ in certain respects from posts 244, project both outwardly and distally from ring 242 as shown by the perspective view of FIG. 12, taken generally in the same direction as FIG. 9. Ring 242 has generally flat, parallel proximal and distal faces 246, 248 respectively, a radially inner face 247, and a radially outer face 249. As in retainer 240, retainer 240A contains a pair of concave recesses 250, 252 in distal face 248 on diametrically opposite sides, and at 90° to recesses 250, 252, proximal face 246 contains a pair of concave recesses 254, 256.

After core 46 has been assembled into bobbin 48, retainer 240A is aligned with the proximal end of the bobbin and circumferentially indexed to align each post 244A with a corresponding receptacle 232. The retainer is then advanced to cause the distal end of each post 244A to enter a respective receptacle 232 in which a respective key 218 of core 46 has already been lodged.

Like retainer 240, retainer 240A possesses the capability for centering an additional magnetic circuit element 260, if present, to the core, and at distal face 248, portions of the inner edge of ring 242 which are to either side of recesses 250, 252 contain a chamfer 258 that is concentric with the centerline of the retainer for centering an element 260. After the retainer has been finally positioned in the bobbin, the encapsulant is introduced to encapsulate core 46. The encapsulant may also encapsulate the retainer and element 260 if the latter is present.

Retainer 240A is also preferably fabricated from a suitable plastic using an injection molding process. For conveniently securing retainer 240A to bobbin 48 to capture core 46 and any additional magnetic circuit elements in the bobbin interior, posts 244A are constructed to include catches 270 at their outer lengthwise edges. Each post 244A comprises a notch 272 that allows the portion 274 of the post containing the catch to flex slightly inward as the retainer is being inserted into the bobbin. Such flexing occurs because each catch is dimensioned to protrude slightly beyond the outer wall of the respective receptacle 232 attempts to enter the receptacle, and the interference will cause the flexing to allow the catch to enter the receptacle. Each catch has an inclined leading edge 276 that wipes across the edge of the receptacle to facilitate the flexing. When the retainer has been advanced to a final position, each catch assumes registration with a respective hole 279 in the bobbin wall. The flexed portion relaxes to lodge the catch in the hole, creating an interference that prevents the retainer from being extracted from the bobbin unless all catches are released.

With constructional features of module 40 having been described, attention can now be directed to a description of steps in fabricating the module. One step in the fabrication process comprises assembly of secondary bobbin 48 to primary bobbin 50 by inserting the distal end of the former into the open proximal end of the latter through bowl 66, and advancing the secondary bobbin to cause terminal 54 to engage the proximal end of terminal 100. Because secondary bobbin 48 and its coil 58 are disposed within the hollow interior of primary bobbin 50, and because the hollow interior of primary bobbin 50 is closed, except for being open at its proximal end, primary bobbin 50 can function, during the process of fabricating module 40, as a liquid container for holding a secondary coil encapsulant, which is shown at 194 in FIGS. 2 and 3. Hence, secondary bobbin 48 and coil 58 are assembled into the hollow interior of primary bobbin 50 before secondary encapsulant 194 is introduced. Sufficient radial clearance is provided between secondary coil 58 and the interior surface of primary bobbin wall 62 to allow for an appropriate secondary coil encapsulant 194, such as epoxy or oil, to be introduced in liquid form into bowl 66 and flow distally into the interior of primary bobbin 50 and fill annular space surrounding secondary bobbin 48 and secondary coil 58 to a level sufficient to fully cover the latter. The fill level may extend into bowl 66 to where the electric terminals at the proximal ends of the bobbins mate with terminals of connector assembly 44.

Another step in the fabrication process comprises encapsulating core 46 within secondary bobbin 48 to create an encapsulant 280 that fills the space between core 46 and the interior wall surface of bobbin 48, as particularly shown by FIG. 2. This step may be conducted either before or after assembly of the secondary bobbin to primary bobbin 50. When secondary coil 58 is encapsulated by secondary encapsulant 194 before core 46 is encapsulated by core encapsulant 280, it is desirable that the proximal end of bobbin 48 protrude above the rim of a bowl 66 to avoid the possibility of any secondary encapsulant that might overflow bowl 66 entering the interior of bobbin 48. This may be particularly important where the respective encapsulants are different materials. Silicone rubber is a preferred material for core encapsulant 280. It may also be observed that opposite sides of outer face 249 of ring 242 have flat zones 275, 277 that are parallel, and perhaps even co-planar with, core faces 204, 206. Zones 275, 277 cooperate with the inner surface of the secondary bobbin sidewall to allow encapsulant that has been introduced into the bobbin through the open center of ring 242 and flowed through recesses 254, 256, to pass distally directly into space 211 between faces 204, 206 and the inner surface of the bobbin sidewall. Encapsulant can also reach the portions of space 211 between faces 204, 206 and the inner surface of the bobbin sidewall by that flowing through the open area present between the bobbin sidewall and each zone 275, 277. Recesses 250, 252 allow encapsulant that has been introduced into the bobbin through the open center of ring 242 to flow outwardly and thence distally to the portions of space 211 that lie between zones 208, 210 of core 46 and the bobbin sidewall.

After core 46 has been encapsulated within bobbin 48, bobbin 48 has been assembled into bobbin 50 and secondary coil 58 encapsulated, environmental shield 42 is fabricated, such as by the injection molding of suitable material, silicone rubber for example, onto the assembled bobbins in a suitably constructed mold. Material injected during fabrication of the environmental shield may also be allowed to flow into space between primary coil 56 and shield 52 thereby encapsulating the primary coil directly on the primary bobbin. After having been injected, the material is allowed to cure, creating the final shape. Hence, primary bobbin 50 serves as a container for encapsulant 194 to encapsulate secondary coil 58, and environmental shield 42 serves as an encapsulant of the module except for leaving exposed electric terminals that connect the module in an ignition system.

Figure 11:
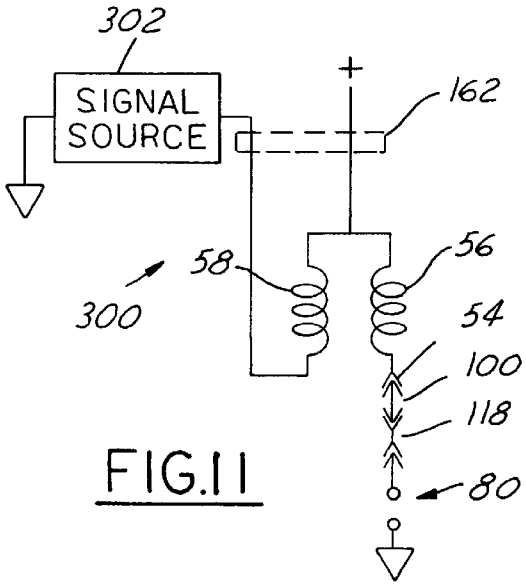
FIG. 11 is a schematic electric circuit diagram illustrating use of the module in an ignition system.

FIG. 11 shows how module 40 is operatively connected with an electric ignition circuit 300 for firing a spark plug 80. Circuit 300 comprises a signal source 302 between ground and one terminal of connector 162. The other terminal of connector 162 is connected to a suitable primary potential relative to ground. One spark plug electrode is connected to ground through the engine via the mounting of the spark plug in the spark plug bore. The central spark plug electrode is connected through terminals 118, 100, 54 to once side of secondary coil 58.

When signal source 302 is in a low impedance state, primary current is established in primary coil 56. At proper time for firing spark plug 80, signal source 302 switches to a high impedance state. Current in primary coil 56 is suddenly interrupted, causing a magnetic field coupling the primary and secondary coils to collapse, and thus inducing secondary voltage in secondary coil 58 sufficient to fire spark plug 80.

While a presently preferred embodiment has been illustrated and described, it is to be appreciated that the invention may be practiced in various forms within the scope of the following claims.

What is claimed is:

1. An ignition coil module having a proximal longitudinal end and a distal longitudinal end, wherein the module defines longitudinal centerline, the module comprising:

a primary coil for conducting primary electric current;

a secondary coil and electromagnetically coupled to the primary coil;

a bobbin disposed coincident with the longitudinal centerline of the module, wherein the bobbin has a sidewall having an inner surface defining a hollow interior space and an outer surface on which one of the coils is disposed;

a ferromagnetic core disposed within the hollow interior space of the bobbin, the ferromagnetic core having a confronting area, wherein the confronting area is spaced from the inner surface of the sidewall of the bobbin; and a retainer that fits to a proximal end of the bobbin to capture the core within the bobbin;

wherein the retainer comprises a ring that is disposed within the interior space and comprises formations that provide clearance to the bobbin sidewall to allow an encapsulant that is introduced into the interior space via the proximal end of the bobbin to flow past the retainer and fill an interior space between the core and the bobbin.

2. The module as set forth in claim 1 wherein the retainer ring comprises a proximal and distal faces, such that the formations in the ring comprise of at least one concave recess in the proximal and distal faces wherein the at least one concave recess passes radially through the ring between a radially inner face of the ring and a radially outer face of the ring.

3. The module as set forth in claim 2 wherein the at least one concave recess in the proximal face of the ring is circumferentially indexed from the at least one concave recess in the distal face of the ring.

4. The module as set forth in claim 3 wherein the at least one concave recess in the proximal face of the ring comprises two concave recesses opposite each other, and the at least one concave recess in the distal face of the ring comprises two concave recesses opposite each other and circumferentially indexed from the two concave recesses in the proximal face of the ring.

5. The module as set forth in claim 2 in which the core, the retainer, and the bobbin comprise respective formations that circumferentially locate the core to the bobbin and circumferentially locate the retainer to the bobbin so as to circumferentially relate the concave recesses to the core.

6. The module as set forth in claim 1 further including a cylindrical magnetic circuit element disposed between the retainer and a proximal end of the core and wherein the retainer acts to center the magnetic circuit element to the core.

7. The module as set forth in claim 1 in which the retainer the retainer and the bobbin comprises at least one catch that catches the retainer and the bobbin to the other.

8. An ignition coil module having a proximal longitudinal end and a distal longitudinal end, wherein the module defines a longitudinal centerline, the module comprising:

a primary coil for conducting primary electric current;

a secondary coil electromagnetically coupled to the primary coil;

a bobbin disposed coincident with the longitudinal centerline of the module, wherein the bobbin has a sidewall having an inner surface defining a hollow interior space and an outer surface on which one of the coils is disposed;

a molded synthetic part disposed interiorly in the bobbin, wherein the molded synthetic part comprises formations that allow the core to be aligned with the longitudinal centerline of the module;

wherein the formations comprise a first formation in the molded synthetic part toward the proximal longitudinal end of the module and a second formation in the molded synthetic part toward the distal longitudinal end of the module such that the second formation comprises raised surface areas that in radial cross section are inclined at an acute angle to the module longitudinal centerline of the module and act to center the core to the bobbin; and a ferromagnetic core disposed within the hollow interior space of the bobbin, the core having a confronting area, wherein the confronting area is spaced from the inner surface of the sidewall of the bobbin.

9. The module as set forth in claim 8, in which the core comprises at least one key toward the proximal longitudinal end of the module, and the first formation comprises at least one receptacle to receive the at least one key to center the core to the bobbin at the proximal longitudinal end of the module and to constrain the core within the bobbin.

10. The module of claim 9, wherein the at least one key projects outward from the core towards the bobbin, wherein the at least one key is located circumferentially around the core, the at least one receptacle receiving the at least one key.

11. An ignition coil module having a proximal longitudinal end and a distal longitudinal end, wherein the module defines a longitudinal centerline, the module comprising:

a primary coil for conducting primary electric current;

a secondary coil electromagnetically coupled to the primary coil;

a bobbin disposed coincident with the longitudinal centerline of the module, wherein the bobbin has a sidewall having an inner surface defining a hollow interior space and an outer surface on which one of the coils is disposed, and further comprising a molded synthetic part;

a retainer fitting to a proximal end of the bobbin to capture the core within the bobbin; and a ferromagnetic core disposed within the hollow interior space of the bobbin, the core having a confronting area, wherein the confronting area is spaced from the inner surface of the sidewall of the bobbin.

12. The module as set forth in claim 11 further including a magnetic circuit element that is captured between the retainer and a longitudinal end of the core.

13. The module of claim 11, wherein the retainer further comprises a circular ring having at least one post, such that the at least one post on the circular ring coincides with the at least one key on the core and the corresponding at least one receptacles.

* * * * *

UNITED STATES PATENT AND TRADEMARK OFFICE

CERTIFICATE OF CORRECTION

PATENT NO. : 6,650,219 B1
DATED : November 18, 2003
INVENTOR(S) : Alex W. Widiger et al.

It is certified that error appears in the above-identified patent and that said Letters Patent is hereby corrected as shown below:

Column 12,
Line 2, before "and the bobbin" delete "the retainer".

Signed and Sealed this

Sixth Day of April, 2004

JON W. DUDAS
*Acting Director of the United States Patent and Trademark Office*